US007937005B2

(12) United States Patent
Hayashi et al.

(10) Patent No.: US 7,937,005 B2
(45) Date of Patent: May 3, 2011

(54) IMAGE FORMING APPARATUS FOR PROCESSING AN IMAGE IN ACCORDANCE WITH A SHEET SIZE OF AN IMAGE TRANSFER SHEET

(75) Inventors: Kyoichiro Hayashi, Osaka (JP); Yasuhiro Iwashima, Osaka (JP); Keiko Morita, Osaka (JP)

(73) Assignee: Kyocera Mita Corporation (JP)

( * ) Notice: Subject to any disclaimer, the term of this patent is extended or adjusted under 35 U.S.C. 154(b) by 680 days.

(21) Appl. No.: 12/016,655

(22) Filed: Jan. 18, 2008

(65) Prior Publication Data

US 2008/0175609 A1 Jul. 24, 2008

(30) Foreign Application Priority Data

Jan. 23, 2007 (JP) ..... 2007-012382

(51) Int. Cl.
*G03G 15/00* (2006.01)

(52) U.S. Cl. ..... 399/45; 399/82

(58) Field of Classification Search ..... 399/45, 399/81, 82

See application file for complete search history.

(56) References Cited

U.S. PATENT DOCUMENTS 5,420,669 A * 5/1995 Imada ..... 399/45
6,785,507 B2 * 8/2004 Asai et al. ..... 399/45
7,808,663 B2 * 10/2010 Teranishi et al. ..... 399/82

FOREIGN PATENT DOCUMENTS

JP 6-148990 5/1994

* cited by examiner

*Primary Examiner* — William J Royer
(74) *Attorney, Agent, or Firm* — Gerald E. Hespos; Michael J. Porco

(57) ABSTRACT

A ROM (18) stores image forming driver information associated with a plurality of size groups into which a plurality of sets of sheet sizes close to each other are respectively sorted. When a sheet size of an image transfer sheet designated by an operator through an operating section (19) and a sheet size of an image transfer sheet detected by an image transfer sheet sensor (21) are different from one another, but both of the image transfer sheet sizes fall in the same size group, a CPU (15) allows an image forming section (16) to execute an image forming processing in accordance with image forming driver information corresponding to the image transfer sheet size designated by the operating section (19).

8 Claims, 4 Drawing Sheets

FIG. 2

| GROUP | SIZE |
|---|---|
| A4(R) GROUP | A4(R) |
| | Letter(R) |
| A4(E) GROUP | A4(E) |
| | Letter(E) |
| | B5(E) |
| B4 GROUP | Legal |
| | B4 |
| | Oficio II |
| | Fools Cap |
| | Folio |
| A3 GROUP | A3 |
| | Ledger |
| | Computer Form |
| A5 GROUP | A5 |
| | Statement |
| POSTCARD GROUP | A6 |
| | POST |

FIG. 3

| DETECTION MODE | SIZE | GROUP | OPERATION (DRIVER INFORMATION) |
|---|---|---|---|
| MANUAL SIZE SETTING | USER-DESIGNATED SIZE | — | USER SIZE |
| AUTOMATIC SIZE DETECTION | IMPOSSIBLE | — | USER SIZE |
| | POSSIBLE | SAME GROUP | USER SIZE |
| | | DIFFERENT GROUP | DETECTED SIZE |

IMAGE FORMING APPARATUS FOR PROCESSING AN IMAGE IN ACCORDANCE WITH A SHEET SIZE OF AN IMAGE TRANSFER SHEET

BACKGROUND OF THE INVENTION

1. Field of the Invention

The present invention relates to an image forming apparatus. More particularly, it relates to a technology of performing image forming in accordance with a sheet size of an image transfer sheet.

2. Description of the Related Art

Conventionally, there has been a known image forming apparatus in which a document size and an image transfer sheet size are detected, and an image transfer sheet having a sheet size matching with the document size is selected, and then image forming is performed, with use of a copying function or the like. Further, another image forming apparatus is known which has a function of performing image forming to an image transfer sheet (for example, an image transfer sheet set on a manual feeding tray) without enlarging or reducing a document size even if image forming is performed to an image transfer sheet having a sheet size different from that of the document (for example, Japanese Patent Unexamined Publication No. H06-148990).

However, according to the image forming apparatus so configured as described above, for example, in the case where image forming is performed with respect to an image transfer sheet having a sheet size which is smaller than a document size, and a document image exists at a portion beyond the image transfer sheet, toners remain on a photoconductive member and are not transferred to the image transfer sheet, so that it causes problems such as waste of toners and damages to the photoconductive member and peripheral equipments.

Further, when a designated sheet size of an image transfer sheet is different from a sheet size of an image transfer sheet actually set on a manual feeding tray (an image transfer sheet on which an image is actually formed), a post processing apparatus (finisher) is so set as to perform an operation suitable for the designated image transfer sheet size. Accordingly, since the sheet size of the image transfer sheet actually conveyed is different, for example, problems occurs, such as (1) a jam caused by abnormality in a width adjustment of an image transfer sheet which is subjected to post-processing, and (2) a jam error detected when an image transfer sheet having a sheet size larger than a sheet size so set as to be subjected to the post-processing is conveyed to the post processing apparatus, a sheet-feeding sensor provided in the post-processing apparatus detects an unexpected sheet size which is larger than the set sheet size since a driver used for the image forming processing with respect to the image transfer sheet is suitable for the set sheet size.

SUMMARY OF THE INVENTION

The present invention was made to solve the problems described above, and its object is to prevent image forming which causes damages and errors to an image forming apparatus while maintaining a user's desirable image quality even in the case where an image transfer sheet size designated by an operator is different from a sheet size of an image transfer sheet provided in advance.

In summary, the present invention includes an image forming apparatus comprising: a designating section for allowing an operator to input a designation of a sheet size of an image transfer sheet; a sheet size detecting section for detecting a sheet size of an image transfer sheet provided in advance; a storage section for storing image forming driver information associated with a sheet size designated by the designating section; an image forming unit for performing image forming; and a controller for allowing the image forming unit to perform image forming in accordance with the image forming driver information stored in the storage section. The storage section stores driver information associated with each of a plurality of size groups into which a plurality of sets of sheet sizes close to each other are respectively sorted, and the controller allows the image forming unit to perform image forming to an image transfer sheet in accordance with image forming driver information associated with the sheet size designated by the designating section when the designated sheet size falls in the size group including a sheet size detected by the sheet size detecting section.

These and other objects, features and advantages of the present invention will become more apparent upon reading of the following detailed description along with the accompanied drawings.

BRIEF DESCRIPTION OF THE DRAWINGS

FIG. 2 illustrates size groups of image transfer sheets which are used in the image forming apparatus in accordance with the embodiment of the present invention.

FIG. 3 illustrates operations associated with image transfer sheet size detection modes of the image forming apparatus in accordance with the embodiment of the present invention.

DETAILED DESCRIPTION OF THE PREFERRED EMBODIMENTS

Figure 1:
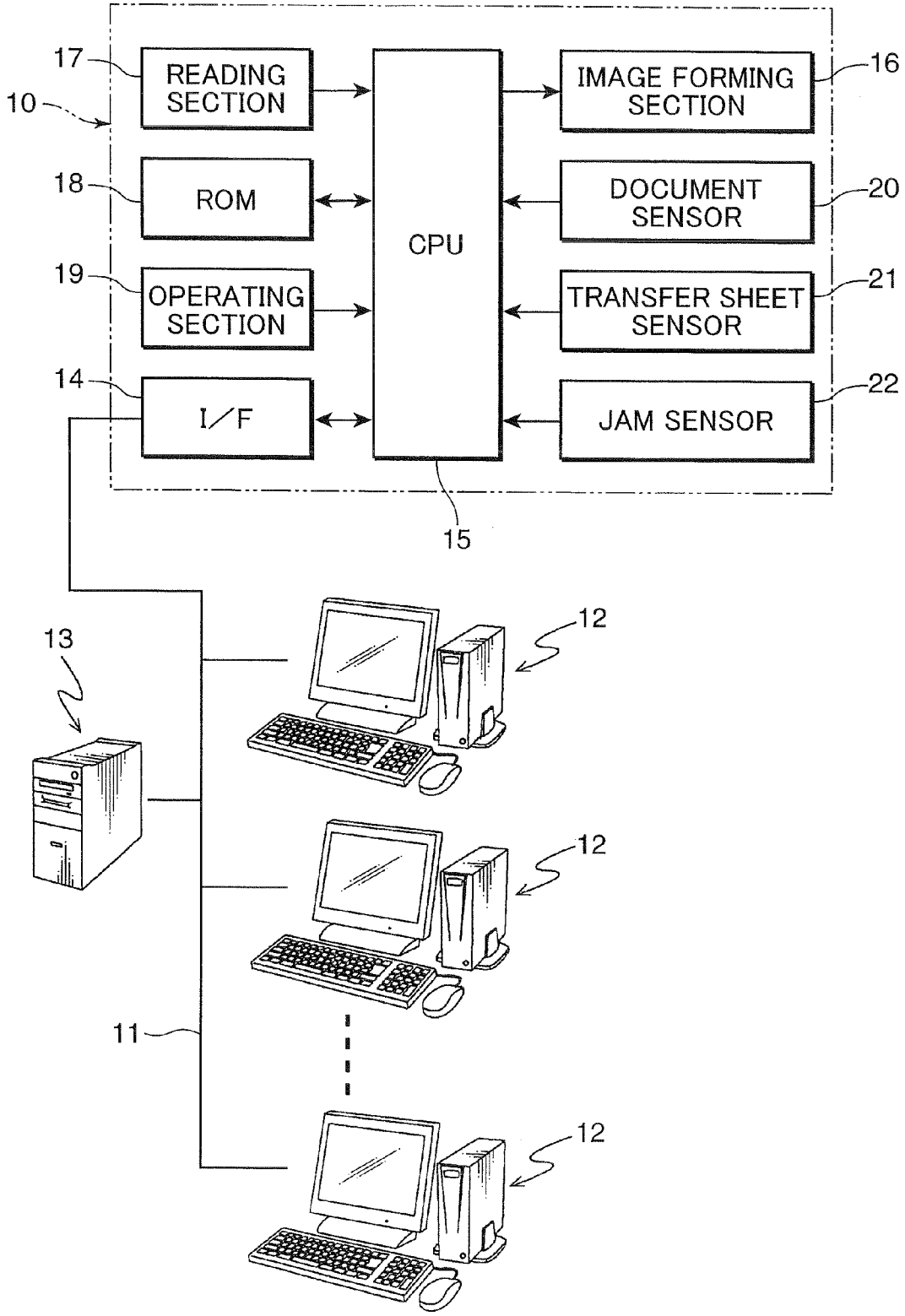
FIG. 1 is a block diagram showing a system configuration of an image forming apparatus in accordance with an embodiment of the present invention.
Figure 4:
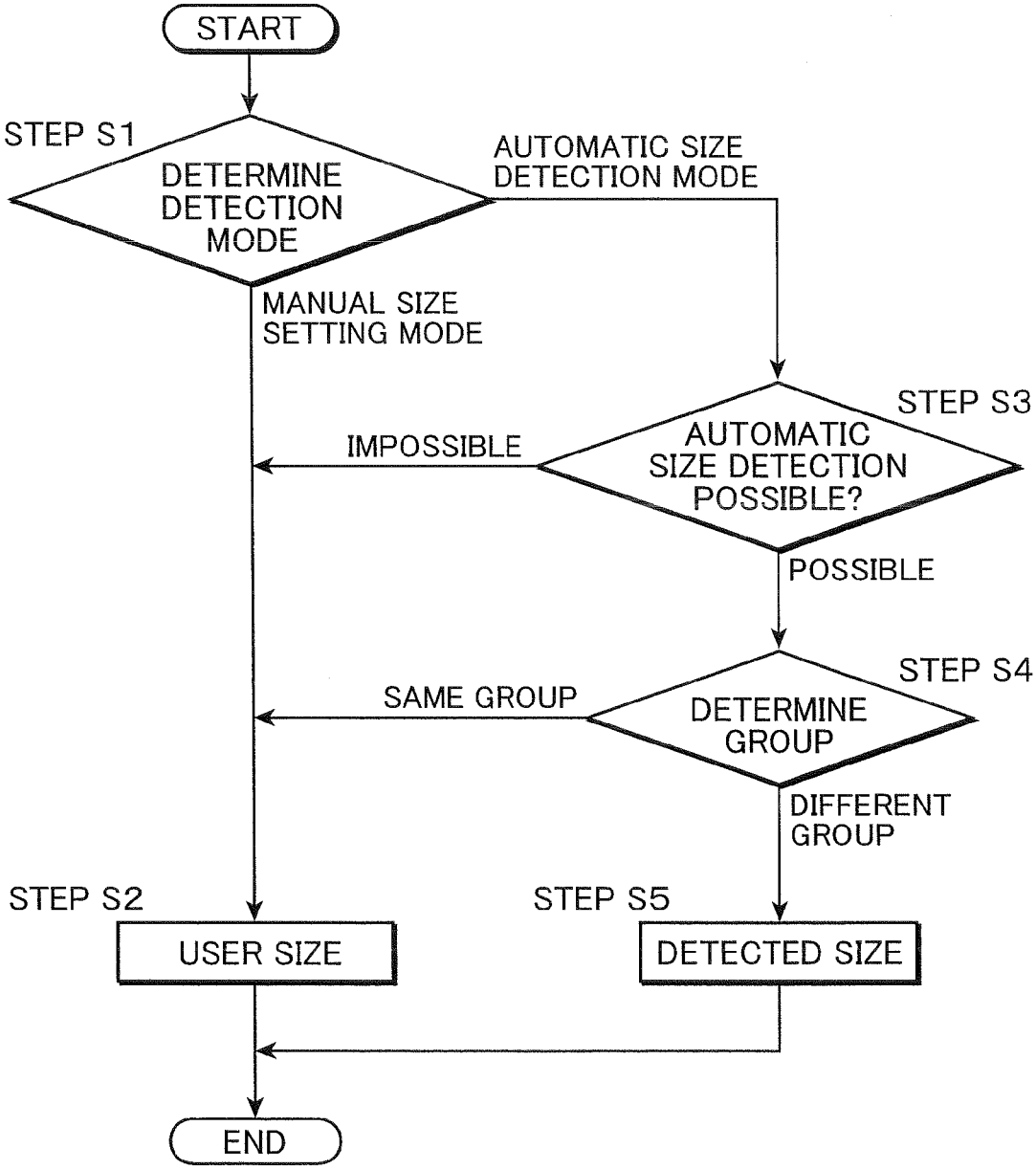
FIG. 4 is a flowchart showing an operation of the image forming apparatus in accordance with the embodiment of the present invention.

Hereinafter, an image forming apparatus in accordance with an embodiment of the present invention will be described with reference to the drawings. FIG. 1 is a block diagram showing a system configuration of the image forming apparatus in accordance with the embodiment of the present invention. FIG. 2 illustrates size groups of image transfer sheets which are used in the image forming apparatus in accordance with the embodiment of the present invention. FIG. 3 illustrates operations associated with image transfer sheet size detection modes of the image forming apparatus in accordance with the embodiment of the present invention. FIG. 4 is a flowchart showing an operation of the image forming apparatus in accordance with the embodiment of the present invention.

As shown in FIG. 1, a complex machine 10, which is an example of the image forming apparatus in accordance with the embodiment of the present invention, has a copying function, a facsimile function, a printer function, and the like, and is connected to a plurality of terminals (personal computer and the like) 12 and a server 13 through a network line 11. The server 13 may be used as a printer server with respect to the complex machine 10, and also used generally as a network server (including an interne server and the like) with respect to the network line 11.

In the complex machine 10, a print instruction which is outputted from the terminal 12 or the like through the network line 11 is inputted to a CPU (controller) 15 through an interface 14. The CPU 15 allows an image forming section 16 to execute an image forming processing in accordance with the print instruction. Further, in the complex machine 10, an image of a document (not illustrated) set on a document holding glass or an automatic document feeding device (also not illustrated) is read by a reading section 17 or received as FAX data, and the image forming section 16 performs an image forming processing in accordance with the image data which is read or received.

At this time, the CPU 15 reads from a ROM (storage section) 18 driver information associated with various functions (such as a printer function, a copying function, and a facsimile function) which are performed at a time when the image forming is performed to control the image forming section 16 and the like. Further, the CPU 15 reads from the ROM 18 driver information associated with operations instructed by an operator through an operating section 19 including button switches such as numerical keys and a liquid crystal panel of a touch-panel type (both of those are not illustrated) to control the image forming section 16 in accordance with the read driver information. Furthermore, the CPU 15 controls various drive systems (for example, a sheet feeding roller, a conveying roller, and the like) in accordance with an output signal transmitted from a document sensor 20 for detecting a sheet size of a document set on a document holding glass and an automatic document feeding device, a transfer sheet sensor 21 for detecting a sheet size of an image transfer sheet (not illustrated) set in a sheet supplying cassette or on a manual feeding tray (both of those are not illustrated) and set in advance as an image transfer sheet for use in image forming, a jam sensor 22 arranged on a feeding/conveying path (not illustrated) of the complex machine 10. This allows the CPU 15 to obtain a sheet size of an image transfer sheet set in the sheet supplying cassette or on the manual feeding tray for use in image forming in accordance with an output signal outputted from the transfer sheet sensor 21.

Further, a mode such as an automatic copying mode for selecting a sheet-feeding cassette or a manual feeding tray to which an image transfer sheet of a sheet size matching with a document size detected by the document sensor 20 and allowing the image forming section 16 to perform image forming to the image transfer sheet is set to the operating section 19 through an operation performed by an operator with respect to the operating section 19. For example, in the case where the automatic copying mode is set in the operating section 19, the CPU 15 allows the image forming section 16 and the like to perform an operation in the automatic copying mode described above. At this time, the CPU 15 reads driver information associated with a sheet size of an image transfer sheet for use in image forming from the ROM 18 to control various drive systems. For example, the CPU 15 controls detection timing and the like of the jam sensor 22.

As shown in FIG. 2, the ROM 18 stores a plurality of size groups into which a plurality of sets of sheet sizes close to each other are respectively sorted. Further, the ROM 18 stores driver information provided in advance respectively for image transfer sheet sizes for use in an image forming processing. Each of the size groups indicates a range within which image forming can be performed while maintaining a predetermined image quality (for example, image quality which is the same as the one which can be obtained in the case where driver information for a certain image transfer sheet size is used to perform image forming with respect to an image transfer sheet having a sheet size which corresponds to the driver information) with respect to an image transfer sheet having a different sheet size even when driver information for a certain image transfer sheet size is used to perform image forming with respect to the image transfer sheet having the different sheet size. In other words, each of the above-described size groups indicates a capacity range which can secure the predetermined image quality in accordance with the same driver information regardless of error in accuracy in sheet sizes between image transfer sheets having the same sheet size, and error in sensitivity of the transfer sheet sensor 21.

Accordingly, for example, it is so set that an image forming processing can be executed at a user's desirable image quality if the designated sheet size and the image transfer sheet size fall in the same size group and the CPU 15 uses the same driver information for the image forming processing, even in the case where the image transfer sheet size different from the document size detected by the document sensor 20 is designated through the operating section 19, or in the case where the image transfer sheet size set on the manual feeding tray is different from the designated size designated through the operating section 19.

Further, in the case where the image transfer sheet size detected by the transfer sheet sensor 21 is considerably different from the sheet size designated by an operator through the operating section 19, in other words, in the case where the image transfer sheet size detected by the transfer sheet sensor 21 and the sheet size designated by the operator through the operating section 19 do not fall in the same size group, the CPU 15 allows the image forming processing to be executed in accordance with driver information associated with the image transfer sheet size detected by the transfer sheet sensor 21. When the image transfer sheet size detected by the transfer sheet sensor 21 is considerably different from the sheet size designated by an operator through the operating section 19, and an image forming processing is executed in accordance with driver information associated with the image transfer sheet size detected by the transfer sheet sensor 21, it causes waste of toners, damages to the photoconductive member and the like, or misdetection in the jam sensor 22. Accordingly, the CPU 15 is set to use the driver information corresponding to a sheet size of an image transfer sheet set for the manual feeding tray to prevent the harmful influences.

Further, in the operating section 19, designation of whether the image transfer sheet size detection by the transfer sheet sensor 21 is used is set in accordance with an operator's operation. In the operating section 19, a manual size setting mode of not performing detection of the image transfer sheet size by the transfer sheet sensor 21 and an automatic size detection mode of performing detection of the image transfer sheet size by the transfer sheet sensor 21 can be set.

As shown in FIG. 3, in the case where the manual size setting mode is set in the operating section 19, the CPU 15 executes an image forming processing in accordance with driver information associated with a designated sheet size of an image transfer sheet which is designated by an operator through the operating section 19.

Further, in the case where the automatic size detection mode is set in the operating section 19, and the designated sheet size of the image transfer sheet designated by an operator through the operating section 19 and the image transfer sheet size detected by the transfer sheet sensor 21 fall in the same group among the size groups shown in FIG. 2, the CPU 15 allows the image forming processing to be executed in accordance with driver information associated with the image transfer sheet size designated through the operating section 19.

Further, in the case where the automatic size detection mode is set in the operating section 19, and the designated sheet size of the image transfer sheet designated by the operator through the operating section 19 and the image transfer sheet size detected by the transfer sheet sensor 21 do not fall in the same group among the size groups shown in FIG. 2, the CPU 15 allows the image forming processing to be executed in accordance with driver information associated with the image transfer sheet size detected by the transfer sheet sensor 21.

Further, in the case where the automatic size detection mode is set in the operating section 19, and the image transfer sheet size designated through the operating section 19 is a sheet size which cannot be detected by the transfer sheet sensor 21 (the sheet size which is beyond a range of a sheet size detection ability of the transfer sheet sensor 21, for example, sheet sizes other than those described in FIG. 2 such as Executive, Envelope, Oficio II, European type), the CPU 15 allows the image forming processing to be executed in accordance with driver information associated with the image transfer sheet size designated through the operating section 19.

In particular, as shown in FIG. 4, the CPU 15 firstly determines which of the manual size setting mode and the automatic size detection mode is selected through the operating section 19 (step S1). When the manual size setting mode is selected ("manual size setting mode" in step S1), the CPU 15 allows the image forming section 16 to execute the image forming processing to an image transfer sheet which is set in advance as an image transfer sheet for use in image forming (for example, an image transfer sheet set on the manual feeding tray) in accordance with driver information associated with the image transfer sheet size designated through the operating section 19 regardless of whether the image transfer sheet size designated through the operating section 19 and the image transfer sheet size detected by the transfer sheet sensor 21 are different from one another (step S2).

On the other hand, in the case where the automatic size detection mode is selected ("automatic size detection mode" in step S1), the CPU 15 determines whether the image transfer sheet size designated through the operating section 19 can be detected by the transfer sheet sensor 21 (step S3). When the image transfer sheet size designated through the operating section 19 cannot be detected by the transfer sheet sensor 21 ("IMPOSSIBLE" in step S3), the CPU 15 allows the image forming section 16 and the like to execute the image forming processing to an image transfer sheet which is set in advance as an image transfer sheet for use in image forming (for example, an image transfer sheet set on the manual feeding tray) in accordance with driver information corresponding to an image transfer sheet size designated through the operating section 19 (step S2). In other words, the size which cannot be detected by the transfer sheet sensor 21 indicates the image transfer sheet size designated through the operating section 19 and not falling in any of the plurality of size groups.

Further, in the case where the image transfer sheet size designated through the operating section 19 can be detected by the transfer sheet sensor 21 in step S3 ("POSSIBLE" in step S3), the CPU 15 determines whether the designated sheet size of the image transfer sheet designated by the operator through the operating section 19 and the image transfer sheet size detected by the transfer sheet sensor 21 fall in the same group among the size groups shown in FIG. 2 (step S4).

Here, when the designated sheet size of the image transfer sheet designated by the operator through the operating section 19 and the image transfer sheet size detected by the transfer sheet sensor 21 fall in the same group among the size groups shown in FIG. 2 ("SAME GROUP" in step S4), the CPU 15 allows the image forming section 16 and the like to execute the image forming processing to an image transfer sheet set in advance as an image transfer sheet for use in image forming (for example, an image transfer sheet set on the manual feeding tray) in accordance with driver information corresponding to the image transfer sheet size designated through the operating section 19 (step S2). On the other hand, when the designated sheet size of the image transfer sheet designated by the operator through the operating section 19 and the image transfer sheet size detected by the transfer sheet sensor 21 do not fall in the same group among the size groups shown in FIG. 2 ("DIFFERENT GROUP" in step S4), the CPU 15 allows the image forming section 16 and the like to execute an image forming processing with respect to an image transfer sheet set in advance as an image transfer sheet for use in image forming (for example, an image transfer sheet set on the manual feeding tray) in accordance with driver information corresponding to the image transfer sheet size detected by the transfer sheet sensor 21 (step S2).

Such designation/changing processing of the driver information can be applied, for example, in the case where an operator sets a document and designates the image transfer sheet size through the operating section 19 and document reading starts, and thereafter the CPU 15 determines that an image transfer sheet size detected by the transfer sheet sensor 21 is different from an image transfer sheet size designated by the operator through the operating section 19, for example, the case where an image transfer sheet initially used for image forming runs out, and an image transfer sheet having a different sheet size is used alternatively. In this case, when the sheet size of the image transfer sheet changed for alternative use and the image transfer sheet size designated though the operating section 19 fall in the same group among the size group shown in FIG. 2, the CPU 15 allows the image forming section 16 and the like to execute an image forming processing to the image transfer sheet changed for alternative use in accordance with the driver information corresponding to the image transfer sheet size designated through the operating section 19. Further, when the sheet size of the image transfer sheet changed for alternative use and the image transfer sheet size designated though the operating section 19 do not fall in the same group among the size groups shown in FIG. 2, the CPU 15 allows the image forming section 16 to execute an image forming to an image transfer sheet changed for alternative use in accordance with driver information corresponding to the image transfer sheet size detected by the transfer sheet sensor 21. According to this, even when a sheet runs out after the document reading is preceded to start, image forming can be executed to an image transfer sheet having a different sheet size while maintaining a constant image quality. Accordingly, a user can allow the document reading to be started without confirming the running out of sheet, convenience for a user improves.

Further, in the above, when a designated sheet size of an image transfer sheet designated by an operator through the operating section 19 and an image transfer sheet size detected by the transfer sheet sensor 21 do not fall in the same group among the size groups shown in FIG. 2, the CPU 15 allows the image forming processing to be executed to an image transfer sheet which is set in advance as an image transfer sheet for use in image forming in accordance with driver information corresponding to the image transfer sheet size detected by the transfer sheet sensor 21. However, instead, when the designated sheet size of an image transfer sheet designated by an operator through the operating section 19 and the image transfer sheet size detected by the transfer sheet sensor 21 do not fall in the same group in the size groups shown in FIG. 2, the CPU 15 may control the image forming section 16 so that the image forming section 16 does not use an image transfer sheet which is set in advance as an image transfer sheet for use in the image forming but an image transfer sheet having other sheet size matching with the size designated by the operator among image transfer sheets set on other sheet-feeding tray or the like or belonging to the same group in the groups shown in FIG. 2.

Further, when the CPU 15 determines that the designated sheet size of the image transfer sheet designated by the operator through the operating section 19 and the image transfer sheet size detected by the transfer sheet sensor 21 do not fall in the same group among the size groups shown in FIG. 2, the CPU 15 may allow an error display to be displayed on a display portion (unillustrated) of the terminal 12 or the complex machine 10 once and thereafter allow the job to be cancelled or display a message for encouraging a user to change the image transfer sheet size.

Further, the controls executed by the CPU 15 may be executed based on software, so that an existing hardware can be directly used for execution of the controls.

Further, in the above-described embodiment, the image forming apparatus in accordance with the present invention is described as the complex machine 10, but it is not for limiting the image forming apparatus in accordance with the present invention to be the complex machine 10. For example, the present invention may be applied generally to an image forming apparatus even if it is an image forming apparatus having other form such as a machine exclusively used for copying.

In summary, the present invention includes an image forming apparatus comprising: a designating section for allowing an operator to input a designation of a sheet size of an image transfer sheet; a sheet size detecting section for detecting a sheet size of an image transfer sheet provided in advance; a storage section for storing image forming driver information associated with a sheet size designated by the designating section; an image forming unit for performing image forming; and a controller for allowing the image forming unit to perform image forming in accordance with the image forming driver information stored in the storage section. The storage section stores driver information associated with each of a plurality of size groups into which a plurality of sets of sheet sizes close to each other are respectively sorted, and the controller allows the image forming unit to perform image forming to an image transfer sheet in accordance with image forming driver information associated with the sheet size designated by the designating section when the designated sheet size falls in the size group including a sheet size detected by the sheet size detecting section.

According to this invention, even when the image transfer sheet size designated by the operator and the image transfer sheet size provided in advance for image forming are different, a user's desirable image quality can be maintained, and image forming causing damages and errors to the image forming apparatus can be prevented.

Further, according to the present invention, the controller allows the image forming unit to perform image forming to an image transfer sheet in accordance with image forming driver information associated with the sheet size detected by the sheet size detecting section when the designated sheet size falls in a size group different from the size group including the sheet size detected by the sheet size detecting section.

Further, according to the present invention, the controller allows the image forming unit to perform image forming in accordance with image forming driver information associated with the sheet size designated by the designating section when the size designated by the designating section does not fall in any of the plurality of size groups.

Further, according to the present invention, the sheet size detecting section can be so set as not to detect a sheet size of an image transfer sheet provided in advance in accordance with an instruction inputted by the operator, and the controller allows the image forming unit to perform image forming in accordance with image forming driver information associated with the sheet size designated by the designating section when the sheet size detecting section is so set as not to detect a sheet size of an image transfer sheet.

Further, according to the present invention, the sheet size detecting section detects a sheet size of an alternative sheet which is supplied alternatively to the image forming unit when the image transfer sheet provided in advance for image forming runs out, and the controller allows the image forming unit to perform image forming to the alternative sheet in accordance with image forming driver information associated with the sheet size designated by the designating section when the sheet size designated by the designating section is different from the sheet size of the alternative sheet detected by the sheet size detecting section, and the sheet size designated by the designating section falls in the size group including the sheet size of the alternative sheet detected by the sheet size detecting section.

Further, according to the present invention, the sheet size detecting section detects a sheet size of an alternative sheet which is supplied alternatively to the image forming unit when the image transfer sheet provided in advance runs out, and the controller allows the image forming unit to perform image forming to the alternative sheet in accordance with image forming driver information associated with the sheet size detected by the sheet size detecting section when the sheet size designated by the designating section is different from the sheet size of the alternative sheet detected by the sheet size detecting section, and the sheet size designated by the designating section falls in a size group different from that of the sheet size detected by the sheet size detecting section.

Further, according to the present invention, the controller allows the image forming unit to perform image forming to an image transfer sheet having a sheet size which is the same as the sheet size designated by the designating section or an image transfer sheet having other sheet size included in the size group including the sheet size designated by the designating section in accordance with image forming driver information associated with the sheet size designated by the designating section when the sheet size designated by the designating section falls in a size group different from that of the sheet size detected by the sheet size detecting section.

Further, according to the present invention, the sheet size detecting section is arranged in a manual feeding tray.

This application is based on Japanese Patent application serial No. 2007-012382 filed in the Japanese Patent Office on Jan. 23, 2007, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus comprising:

a designating section for allowing an operator to input a designation of a sheet size of a sheet;

a sheet size detecting section for detecting a sheet size of a sheet provided in advance;

a storage section for storing image forming driver information associated with a sheet size designated by the designating section;

an image forming unit for performing image forming; and a controller for allowing the image forming unit to perform image forming in accordance with the image forming driver information stored in the storage section, wherein the storage section stores driver information associated with each of a plurality of size groups into which a plurality of sets of sheet sizes close to each other are respectively sorted, and the controller allows the image forming unit to perform image forming to a sheet in accordance with image forming driver information associated with the sheet size designated by the designating section when the designated sheet size falls in the size group including a sheet size detected by the sheet size detecting section.

2. The image forming apparatus according to claim 1, wherein the controller allows the image forming unit to perform image forming to a sheet in accordance with image forming driver information associated with the sheet size detected by the sheet size detecting section when the designated sheet size falls in a size group different from the size group including the sheet size detected by the sheet size detecting section.

3. The image forming apparatus according to claim 1, wherein the controller allows the image forming unit to perform image forming in accordance with image forming driver information associated with the sheet size designated by the designating section when the size designated by the designating section does not fall in any of the plurality of size groups.

4. The image forming apparatus according to claim 1, wherein:

the sheet size detecting section can be so set as not to detect a sheet size of an image transfer sheet provided in advance in accordance with an instruction inputted by the operator, and the controller allows the image forming unit to perform image forming in accordance with image forming driver information associated with the sheet size designated by the designating section when the sheet size detecting section is so set as not to detect a sheet size of an image transfer sheet.

5. The image forming apparatus according to claim 1, wherein:

the sheet size detecting section detects a sheet size of an alternative sheet which is supplied alternatively to the image forming unit when the sheet provided in advance for image forming runs out, and the controller allows the image forming unit to perform image forming to the alternative sheet in accordance with image forming driver information associated with the sheet size designated by the designating section when the sheet size designated by the designating section is different from the sheet size of the alternative sheet detected by the sheet size detecting section, and the sheet size designated by the designating section falls in the size group including the sheet size of the alternative sheet detected by the sheet size detecting section.

6. The image forming apparatus according to claim 1, wherein:

the sheet size detecting section detects a sheet size of an alternative sheet which is supplied alternatively to the image forming unit when the sheet provided in advance runs out, and the controller allows the image forming unit to perform image forming to the alternative sheet in accordance with image forming driver information associated with the sheet size detected by the sheet size detecting section when the sheet size designated by the designating section is different from the sheet size of the alternative sheet detected by the sheet size detecting section, and the sheet size designated by the designating section falls in a size group different from that of the sheet size detected by the sheet size detecting section.

7. The image forming apparatus according to claim 1, wherein the controller allows the image forming unit to perform image forming to a sheet having a sheet size which is the same as the sheet size designated by the designating section or a sheet having other sheet size included in the size group including the sheet size designated by the designating section in accordance with image forming driver information associated with the sheet size designated by the designating section when the sheet size designated by the designating section falls in a size group different from that of the sheet size detected by the sheet size detecting section.

8. The image forming apparatus according to claim 1, wherein the sheet size detecting section is arranged in a manual feeding tray.

* * * * *